US009752307B2

(12) United States Patent
Bewley, Jr. et al.

(10) Patent No.: US 9,752,307 B2
(45) Date of Patent: Sep. 5, 2017

(54) DISPOSAL ASSEMBLY AND METHOD FOR OPERATING SAME

(71) Applicant: General Electric Company, Schenectady, NY (US)

(72) Inventors: Wilbur Carl Bewley, Jr., Nicholasville, KY (US); Hiram Dwayne Cornett, Muldraugh, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 713 days.

(21) Appl. No.: 14/222,713

(22) Filed: Mar. 24, 2014

(65) Prior Publication Data

US 2015/0267386 A1 Sep. 24, 2015

(51) Int. Cl.

| | |
|---|---|
| ***B02C 18/00*** | (2006.01) |
| ***E03C 1/266*** | (2006.01) |
| ***B02C 25/00*** | (2006.01) |
| ***B02C 18/12*** | (2006.01) |

(52) U.S. Cl.

CPC ..... *E03C 1/2665* (2013.01); *B02C 18/0084* (2013.01); *B02C 18/0092* (2013.01); *B02C 18/12* (2013.01); *B02C 25/00* (2013.01)

(58) Field of Classification Search

CPC ..... B02C 25/00; B02C 18/12; B02C 18/0084; B02C 18/0092; B02C 18/2665

USPC ..... 241/32.5, 46.013

See application file for complete search history.

(56) References Cited

U.S. PATENT DOCUMENTS

| | | | | |
|---|---|---|---|---|
| 2,961,172 | A | 11/1960 | Wieczorek et al. | |
| 3,181,800 | A * | 5/1965 | Norén et al. | B02C 17/00 241/24.1 |
| 3,335,969 | A | 8/1967 | Egle | |
| 5,308,000 | A * | 5/1994 | Riley | E03C 1/2665 241/33 |
| 7,500,626 | B2 * | 3/2009 | Berger | E03C 1/2665 241/32.5 |
| 7,503,514 | B2 * | 3/2009 | Berger | E03C 1/2665 241/30 |
| 7,757,981 | B2 | 7/2010 | Anderson et al. | |
| 8,579,217 | B2 * | 11/2013 | Chesack | E03C 1/2665 241/33 |
| 2006/0138246 | A1 | 6/2006 | Stowe et al. | |
| 2007/0215727 | A1 * | 9/2007 | Berger | E03C 1/2665 241/33 |
| 2013/0008985 | A1 * | 1/2013 | Held | B02C 17/1805 241/5 |

(Continued)

FOREIGN PATENT DOCUMENTS

| | | |
|---|---|---|
| JP | 2002-085999 | 3/2002 |

*Primary Examiner* — Faye Francis

(74) *Attorney, Agent, or Firm* — Dority & Manning, P.A.

(57) ABSTRACT

Disposal assemblies and methods for operating disposal assemblies are provided. A disposal assembly includes an inlet conduit defining an inlet passage, and a housing defining a chamber, the chamber in fluid communication with the inlet passage. The disposal assembly further includes a grinding mechanism disposed within the chamber, and a motor connected to the grinding mechanism and operable to drive the grinding mechanism. The disposal assembly further includes a controller in communication with the motor, the controller programmed for selectively and alternately operating the motor in a batch mode and a continuous mode.

7 Claims, 6 Drawing Sheets

(56) References Cited

U.S. PATENT DOCUMENTS

2013/0175375 A1* 7/2013 Jara-Almonte ..... E03C 1/2665
241/46.014

* cited by examiner

DISPOSAL ASSEMBLY AND METHOD FOR OPERATING SAME

FIELD OF THE INVENTION

The present subject matter relates generally to waste disposal assemblies for processing waste and, more particularly, to disposal assemblies having improved operative modes and improved methods for operating disposal assemblies.

BACKGROUND OF THE INVENTION

Waste disposal units are typically used to process solid waste, such as food waste, garbage and/or other waste, into particulates small enough to pass through associated drain plumbing. A conventional waste disposal is configured to be mounted onto a sink drain extending downward from a corresponding sink such that water/waste discharged from the sink may be directed into the disposal. The water/waste is typically directed into a grind chamber. A grinding mechanism may be provided in the grind chamber. The grinding mechanism is coupled to a shaft of a corresponding motor to allow the grinding mechanism to be rotated at high speeds. As the grinding mechanism is rotated by the motor, the waste contained within the grind chamber is ground, shredded, cut and/or otherwise processed into small particulates. The water and processed waste may then be discharged from the disposal and transmitted through the associated plumbing.

Presently known waste disposal units operate in a particular operating mode. Commonly known household units, for example, operate in a continuous mode. In the continuous mode, the motor may run continuously upon actuation of a switch (which is typically wall mounted) and until the switch is de-actuated. Such units have various disadvantages, including safety issues, as the unit requires de-actuation of the switch for the motor to turn off. Other units, which may be utilized for example in households without the availability of a wall-mounted switch for actuation, operate in a batch mode. In the batch mode, a "batch" of waste is provided to the grinding chamber, and for example a stopper is placed in the inlet conduit for the disposal unit. Placement of the stopper may activate the motor. The batch mode is generally considered safer than the continuous mode, due to the requirement of a stopper covering the inlet conduit before activation of the motor. However, many consumers find the requirement of a stopper cumbersome and inefficient.

Accordingly, improved disposal apparatus and methods for operating disposal apparatus are desired in the art. In particular, improvements in the available operation modes for disposal apparatus would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a disposal assembly is provided. The disposal assembly includes an inlet conduit defining an inlet passage, and a housing defining a chamber, the chamber in fluid communication with the inlet passage. The disposal assembly further includes a grinding mechanism disposed within the chamber, and a motor connected to the grinding mechanism and operable to drive the grinding mechanism. The disposal assembly further includes a controller in communication with the motor, the controller programmed for selectively and alternately operating the motor in a batch mode and a continuous mode.

In accordance with another embodiment of the present disclosure, a method for operating a disposal assembly is provided. The method includes operating a motor of the disposal assembly in a batch mode after a main actuation switch is actuated, and operating the motor of the disposal assembly in a continuous mode after the main actuation switch is subsequently actuated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
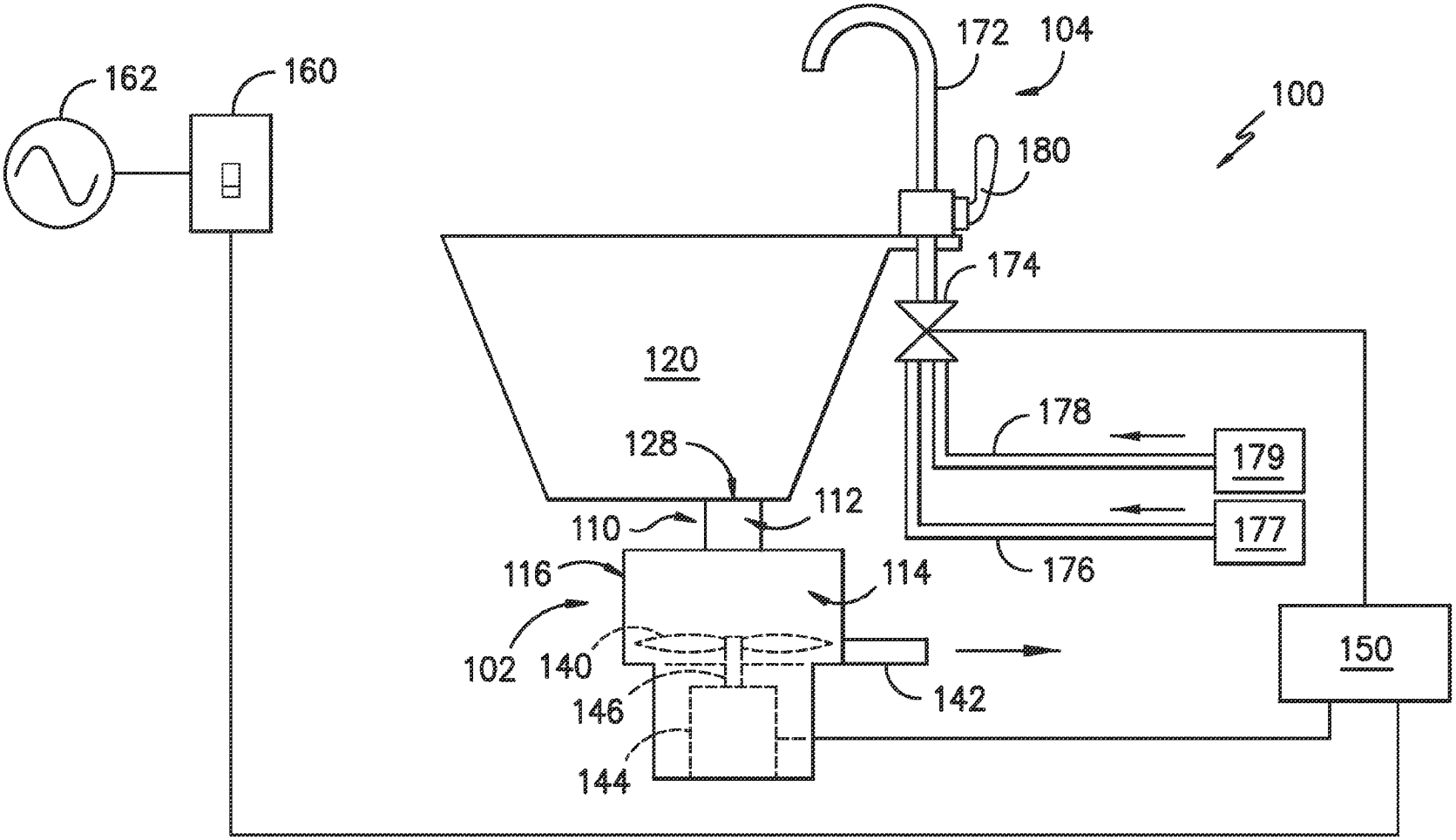
FIG. 1 is a schematic view of a disposal assembly in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, one embodiment of a disposal assembly 100 in accordance with the present disclosure is provided. The disposal assembly 100 generally includes a disposal 102, and may further include a faucet assembly 104. The disposal 102 may include an inlet conduit 110 which defines an inlet passage 112, through which waste may travel to a chamber 114 defined in a housing 116. The chamber 114 is thus in fluid communication with the inlet passage 112.

Figure 2:
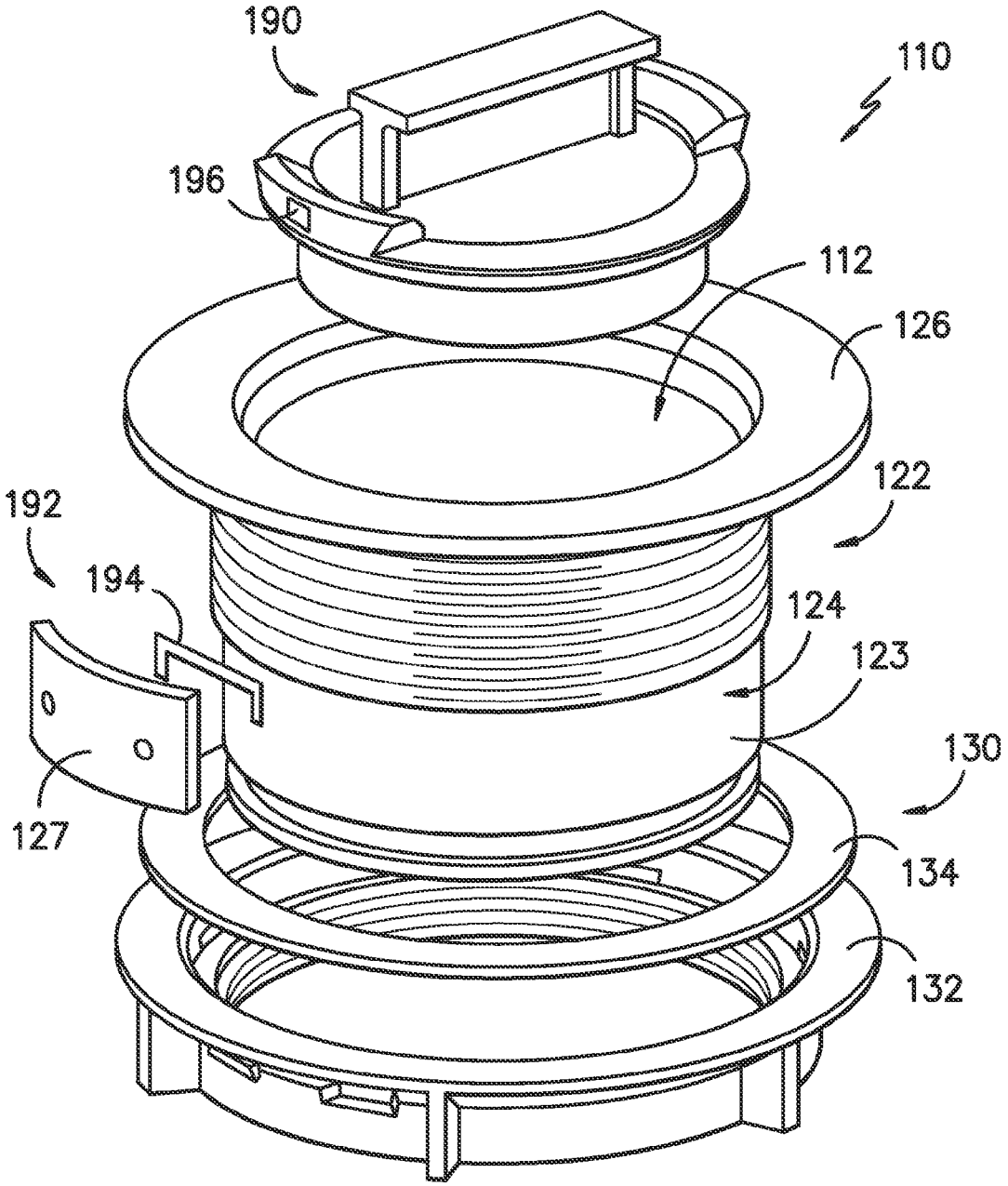
FIG. 2 is a perspective exploded view of various components of a disposal assembly in accordance with one embodiment of the present disclosure.

As illustrated in FIG. 2, the inlet conduit 110 may include various components for coupling the disposal 102 to a sink 120. For example, the inlet conduit 110 may include a sink flange 122, which may include a neck 124 at least partially defining the inlet passage 112 and a disk 126 extending radially from the neck 124. The flange 122 may extend through a drain hole 128 defined in the sink 120 to couple the disposal 102 to the sink 120. The inlet conduit 110 may further include a collar assembly 130, which may include a collar or locking ring 132 and a washer 134. The inlet conduit 110 may couple the inlet conduit 110 to the disposal 102.

Referring again to FIG. 1, disposal 102 may further include a grinding mechanism 140, which may be disposed within the chamber 114. The grinding mechanism 140 may, for example, be a blade or suitable device with one or more cutting surfaces, and may be movable to contact and grind waste within the chamber 114. The grinding mechanism 140 may generally operate to grind waste sufficiently such that the waste can then flow, with water through an outlet conduit 142 of the disposal 102. A motor 144 may be connected to the grinding mechanism 140, and may be operable to drive the grinding mechanism 140. The motor 144 may, for example, be a brush or brushless motor, and may have one or more speeds. A shaft 146 may connect the motor 144 and grinding mechanism 140, such that rotation of the motor 144 is transmitted to and drives the grinding mechanism 140 through the shaft 146.

Motor 144 may additionally be connected to an electrical source, such as electrical source 162 as discussed herein. Further, a current sensor 148 may be in communication with the motor 144 and a controller 150 (discussed herein and illustrated in FIG. 3). The current sensor 148 may generally be operable to sense the current level in the motor 144 during operation thereof.

The disposal assembly 100 may further include, for example, a controller 150. Controller 150 may be in communication with the motor 144, as well as various other assembly 100 components as discussed herein, and may be programmed to operate the motor 144.

It should be appreciated that the controller 150 may generally comprise a computer or any other suitable processing unit. Thus, in several embodiments, the controller 150 may include one or more processor(s) and associated memory device(s) configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) of the controller 150 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) may generally be configured to store suitable computer-readable instructions that, when implemented by the processor(s), configure the controller 150 to perform various computer-implemented functions. In addition, the controller 150 may also include various input/output channels for receiving inputs from and sending control signals to sensors and/or other measurement devices, such as the motor 144 and other components which the controller 150 is in communication with as discussed herein.

Disposal assembly 100 may further include a main actuation switch 160. The main actuation switch 160 may, for example, be a wall mounted switch which toggles between an actuated "on" position and a de-actuated "off" position. The switch 160 may be in communication with the controller 150, and may further be connected to an electrical source 162, such as an alternating current ("AC") power source as illustrated.

Further, in some embodiments, disposal assembly 100 may further include faucet assembly 104, which may include for example, a faucet 172 and a flow valve 174. The faucet 172 may flow water therethrough into the sink 120. The flow valve 174 may be actuatable to allow a flow of water therethrough and to the faucet 172. Hot water line 176 may flow hot water to the valve 174 from a hot water source 177, and cold water line 178 may flow cold water to the valve 174 from a cold water source 179.

In exemplary embodiments, the flow valve 174 is electronically actuatable. For example, the faucet 172 may be a "touch" faucet, wherein user contact with a surface of the faucet 172 actuates the flow valve 174 to allow water to flow therethrough. Faucet 172 may thus include, for example, a capacitive sensor (not shown) which is in communication with the flow valve 174. When the capacitive sensor senses a change in capacitance of the faucet 172 due to user contact, the sensor may actuate the flow valve 174. Faucet 172 may additionally include a main valve (not shown) downstream of the flow valve 174 which is mechanically actuatable by a handle 180 of the faucet 172. The main valve in these embodiments must be open for water to flow from the faucet 172 when the flow valve 174 is actuated to the open position.

In exemplary embodiments, the flow valve 174 may, as illustrated, further be in communication with the controller 150. Accordingly, the flow valve 174 may be actuatable by the controller 150 as discussed herein for use with the disposer 102.

Referring now again to FIG. 2, disposal assembly 100 may further include a stopper 190 which is positionable 190 within the inlet passage 112. Additionally disposal assembly 100 may include a batch actuation assembly 192. When the assembly 100 is operating in batch mode, as discussed herein, actuation of the actuation assembly 192 may cause the motor 144 to operate. Batch actuation assembly 192 may include, for example, a first actuation component 194 and a second actuation component 196. One or both components may be in communication with the controller 150. In exemplary embodiments, alignment of the components 194, 196 may cause actuation of the assembly 192, and de-alignment or mis-alignment may cause the assembly 192 to de-actuate or not be actuated. First actuation component 194 may, for example and as illustrated, be a reed switch. Second actuation component 196 may, for example and as illustrated, be a magnet. Further, the first actuation component 194 may be disposed in the inlet conduit 110, such as between an outer surface 123 of the sink flange 122 and a cover 127 as illustrated. The second actuation component 196 may be disposed in the stopper 190, such as embedded in the stopper 190. Orientation of the stopper 190 within the inlet passage 110 such that the second actuation component 196 is proximate the first actuation component 194 (relative to other orientations of the stopper 190 within the inlet passage 110) may be alignment of the first and second actuation components 194, 196, thus actuating the assembly 192. De-alignment of the first and second actuation components 194 by, for example, changing the orientation of the stopper 190, may de-actuate the assembly 192.

It should be noted that, when the stopper 190 is in the aligned position, it may, while blocking a portion of the inlet passage 112, still allow water to flow from the sink 120 past the stopper 190 and through the inlet passage 112. Accordingly, during disposal 102 operation, water may be flowed thereto despite the use of stopper 190.

Figure 3:
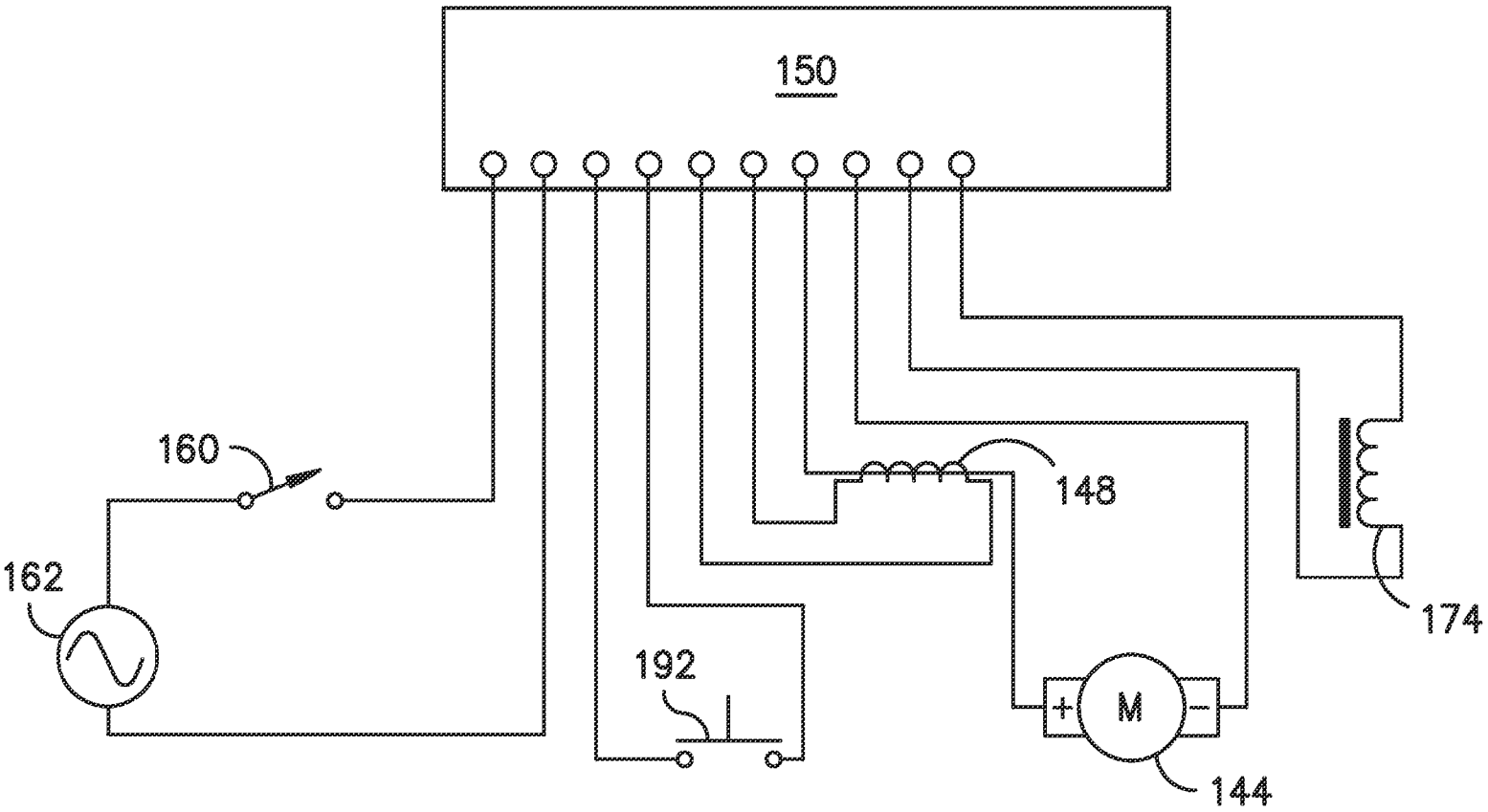
FIG. 3 is a schematic view of various components of a disposal assembly in accordance with one embodiment of the present disclosure.

Referring now to FIG. 3 as well as FIGS. 4 through 7, the controller 150 may be programmed for operating the motor 144 in a variety of modes. In particular, the controller 150 may be programmed for selectively and alternately operating the motor 144 in a batch mode 202 and a continuous mode 204. Accordingly, the disposer assembly 100 may be operated selectively, in the batch mode 202 and the continuous mode 204. Accordingly, the advantageous characteristics of each mode 202, 204 may be utilized by a user as desired.

Figure 5:
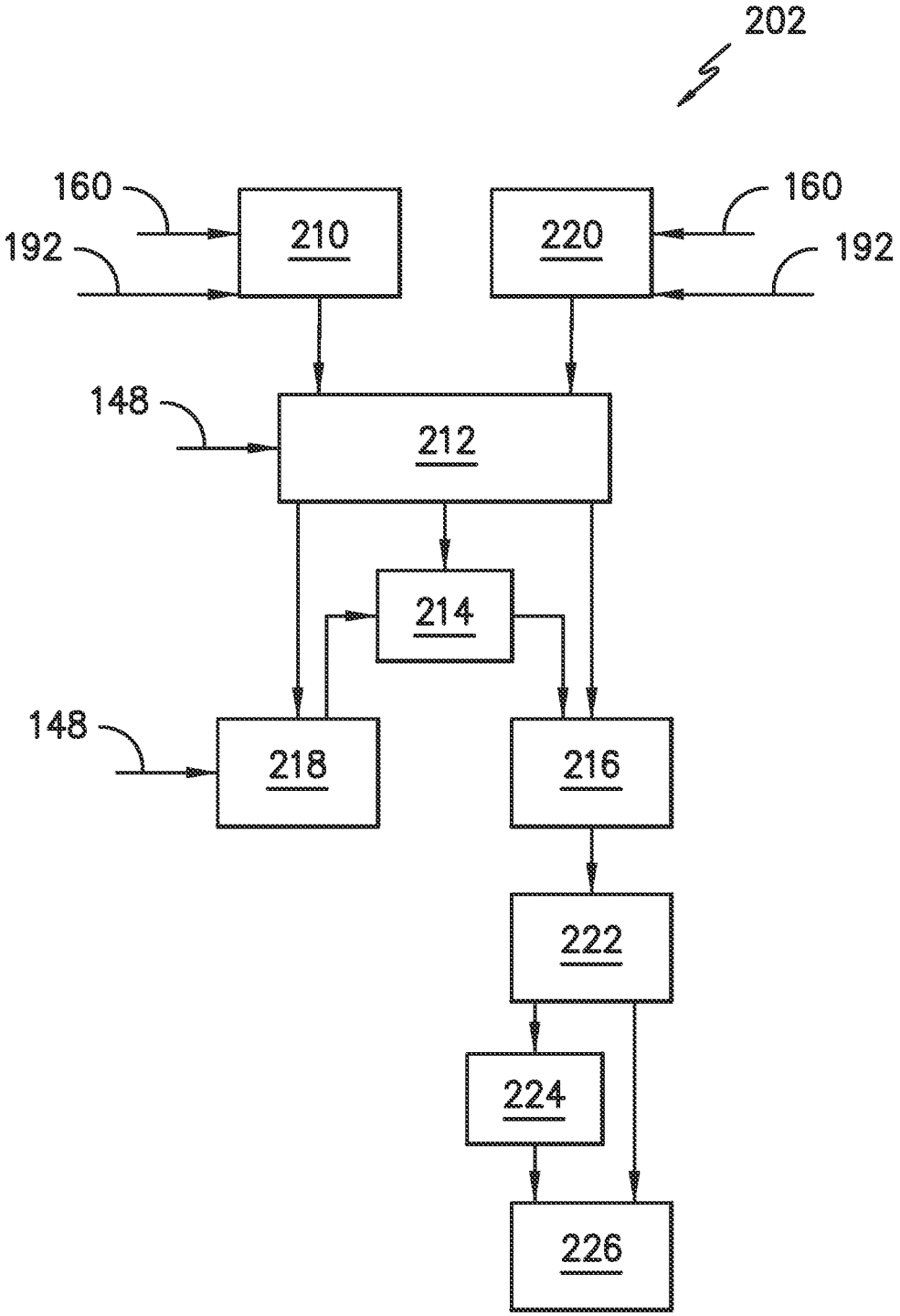
FIG. 5 is a flow chart illustrating operation in a batch mode in accordance with one embodiment of the present disclosure.

As illustrated in FIG. 5, operation in the batch mode 202 may include a variety of steps. The controller 150 may generally facilitate each step by, for example, inputting or outputting signals from/to other components that are in communication with the controller 150. For example, operation in the batch mode 202 may include the step 210 of operating the motor 144 when the main actuation switch 160 is actuated and the actuation assembly 192 is actuated. Accordingly, the main actuation switch 160 may be actuated, but the motor 144 will not operate until the actuation assembly 192 is additionally actuated, as discussed herein. When the actuation assembly 192 is actuated and the main actuation switch 160 remains actuated, the motor 144 may be operated.

During operation of the motor 144, the current level of the motor 144 may be monitored, such as by the current sensor 148. Operation in the batch mode 202 may further include the step 212 of initiating a motor countdown timer 214 for a predetermined motor time period when the current level of the motor 144 is below the predetermined current level. The predetermined motor time period may be stored in the controller 150, and may, for example, be between approximately 3 seconds and approximately 8 seconds. The predetermined current level may additionally be stored in the controller 150, and may, for example, be between approximately 2 amperes and approximately 5 amperes.

Further, operation in the batch mode 202 may include the step 216 of discontinuing operation of the motor 144 if the predetermined motor time period is met. Still further, operation in the batch mode 202 may include the step 218 of discontinuing the motor countdown timer if the current level rises above the predetermined current level. Accordingly, if the current level rises above the predetermined current level, the motor countdown timer may reset, such that the countdown timer may begin anew when step 212 again occurs.

In some embodiments, operation in the batch mode 202 may further include, for example, the step 220 of opening the flow valve 174 when the main actuation switch 160 is actuated and the actuation assembly 192 is actuated. Such step 220 may occur, for example, simultaneously with or before step 210. Accordingly, water may automatically flow from the faucet 172, and thus into the disposer 102, during operation of the motor 144. Operation in the batch mode 202 may further include, for example, the step 222 of initiating a faucet countdown timer 224 for a predetermined faucet time period when operation of the motor is discontinued (see step 216). The predetermined faucet time period may be stored in the controller 150, and may, for example, be between approximately 3 seconds and approximately 8 seconds. Operation in the batch mode 202 may still further include, for example, the step 226 of closing the valve 174 if the predetermined faucet time period is met. Accordingly, the flow of water may automatically be shut off after the motor 144 operation is discontinued.

Figure 7:
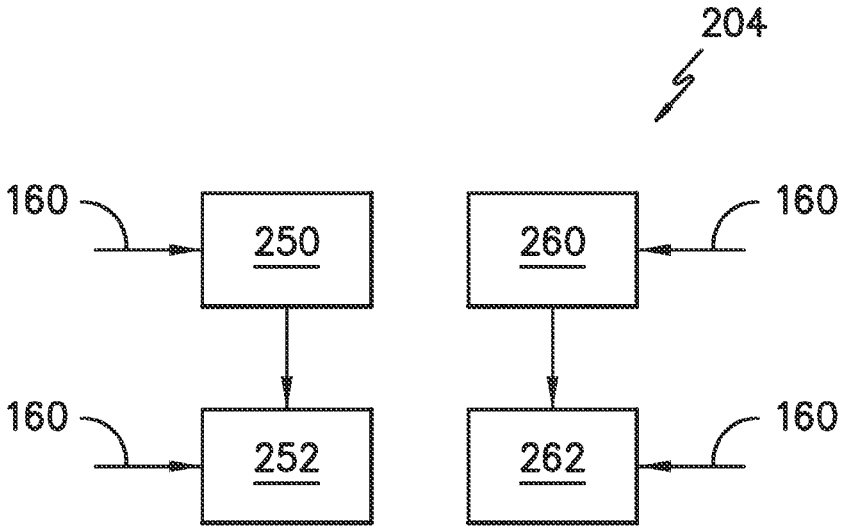
FIG. 7 is a flow chart illustrating operation in a continuous mode in accordance with another embodiment of the present disclosure.
Figure 6:
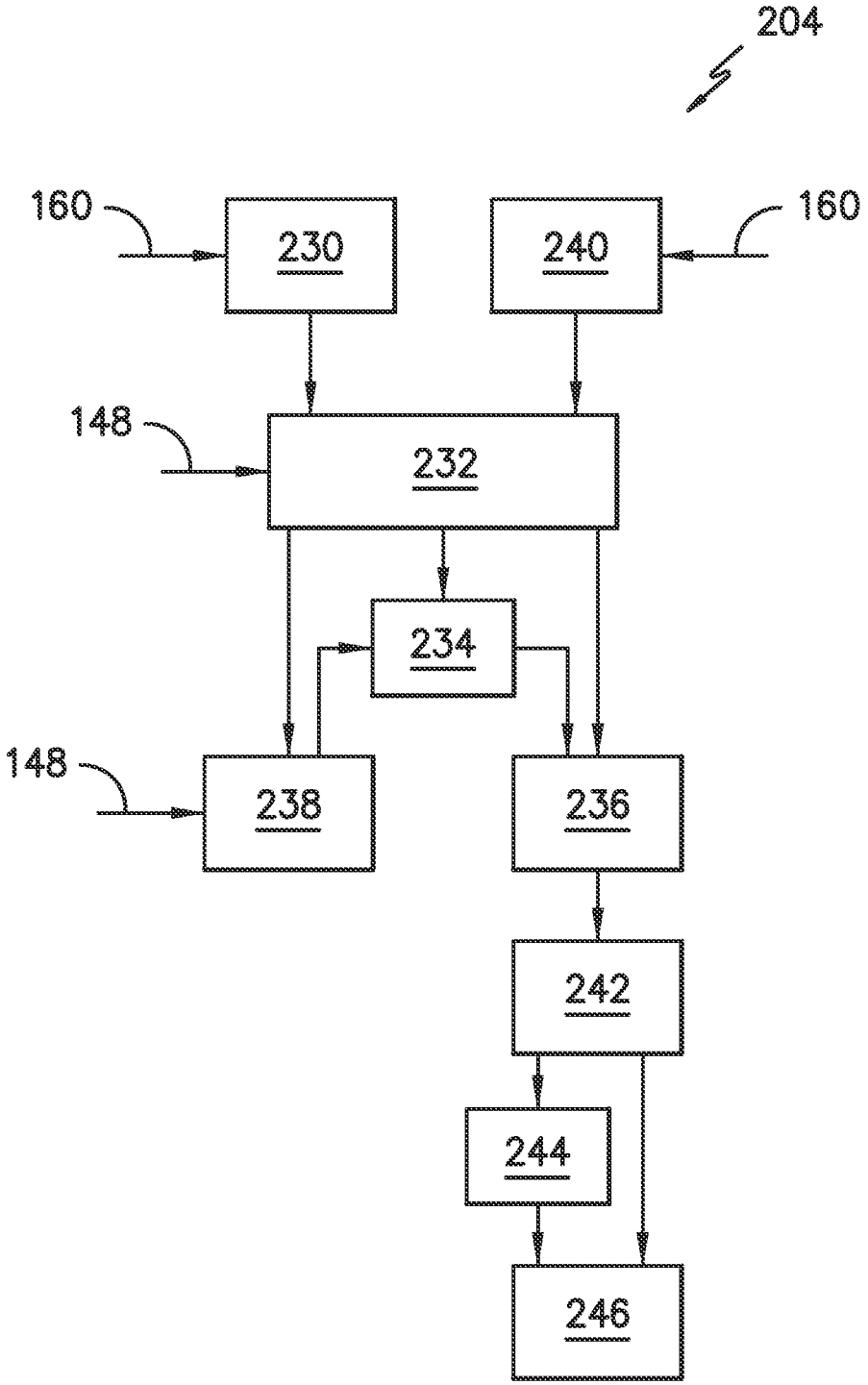
FIG. 6 is a flow chart illustrating operation in a continuous mode in accordance with one embodiment of the present disclosure.

As illustrated in FIGS. 6 and 7, operation in the continuous mode 204 may include a variety of steps. The controller 150 may generally facilitate each step by, for example, inputting or outputting signals from/to other components that are in communication with the controller 150. For example, in one embodiment as illustrated in FIG. 6, operation in the continuous mode 204 may include the step 230 of operating the motor 144 when the main actuation switch 160 is actuated. Accordingly, actuation of the main actuation switch 160 alone may govern initial operation of the motor 144.

During operation of the motor 144, the current level of the motor 144 may be monitored, such as by the current sensor 148. Operation in the continuous mode 204 may further include the step 232 of initiating a motor countdown timer 234 for a predetermined motor time period when the current level of the motor 144 is below the predetermined current level. The predetermined motor time period may be stored in the controller 150, and may, for example, be between approximately 3 seconds and approximately 8 seconds. The predetermined current level may additionally be stored in the controller 150, and may, for example, be between approximately 2 amperes and approximately 5 amperes.

Further, operation in the continuous mode 204 may include the step 236 of discontinuing operation of the motor 144 if the predetermined motor time period is met. Still further, operation in the continuous mode 204 may include the step 238 of discontinuing the motor countdown timer if the current level rises above the predetermined current level. Accordingly, if the current level rises above the predetermined current level, the motor countdown timer may reset, such that the countdown timer may begin anew when step 232 again occurs.

In some embodiments, operation in the continuous mode 204 may further include, for example, the step 240 of opening the flow valve 174 when the main actuation switch 160 is actuated. Such step 240 may occur, for example, simultaneously with or before step 230. Accordingly, water may automatically flow from the faucet 172, and thus into the disposer 102, during operation of the motor 144. Operation in the continuous mode 204 may further include, for example, the step 242 of initiating a faucet countdown timer 244 for a predetermined faucet time period when operation of the motor is discontinued (see step 236). The predetermined faucet time period may be stored in the controller 150, and may, for example, be between approximately 3 seconds and approximately 8 seconds. Operation in the continuous mode 204 may still further include, for example, the step 246 of closing the valve 174 if the predetermined faucet time period is met. Accordingly, the flow of water may automatically be shut off after the motor 144 operation is discontinued.

In an alternative embodiment, as illustrated in FIG. 7, operation in the continuous mode 204 may include the step 250 of operating the motor 144 when the main actuation switch 160 is actuated. Accordingly, actuation of the main actuation switch 160 alone may govern initial operation of the motor 144. Further, operation in the continuous mode 204 may include the step 252 of discontinuing operation of the motor 144 when the main actuation switch 160 is de-actuated. Accordingly, the motor 144 may operate until a user de-actuates the previously actuated switch 160.

In some embodiments, operation in the continuous mode 204 may further include, for example, the step 260 of opening the flow valve 174 when the main actuation switch 160 is actuated. Such step 260 may occur, for example, simultaneously with or before step 250. Accordingly, water may automatically flow from the faucet 172, and thus into the disposer 102, during operation of the motor 144. Operation in the continuous mode 204 may further include, for example, the step 262 of closing the flow valve 174 when the main actuation switch 160 is de-actuated. Such step 262 may occur, for example, simultaneously with or after step 252. Accordingly, the flow of water may automatically cease when motor 144 operation ceases.

In exemplary embodiments and as discussed above, actuation of the main actuation switch 160 may cause operation in the batch mode and in the continuous mode. In particular, the pattern of actuation of the switch 160 may cause the controller 150 to switch the operational mode of the motor 144 between such modes. In exemplary embodiments, sequential actuation of the main actuation switch 160 causes the controller 150 to alternate between operating the motor 144 in the batch mode and operating the motor 144 in the continuous mode. For example, an initial actuation of the switch 160 may cause the controller 150 to operate the controller 150 in batch mode. After the switch 160 is de-actuated, a subsequent actuation of the switch 160 may cause the controller 150 to operate the controller 150 in continuous mode. Further, after the switch is again de-actuated, another subsequent actuation of the switch 160 may cause the controller 150 to operate the controller 150 in batch mode. The step 202 of operating the motor 144 in the batch mode may thus occur only after a step 280 of actuating the main actuation switch 160. The step 204 of operating the motor 144 in the continuous mode may thus occur only after a step 282 of subsequently actuating the main actuation switch 160.

Further, in exemplary embodiments, the step 204 of operating the motor 144 in the continuous mode occurs only if the main actuation switch 160 is subsequently actuated within a predetermined actuation time period 184. The predetermined actuation time period may be stored in the controller 150, and may, for example, be between approximately 1 second and approximately 5 seconds. Further, if the main actuation switch 160 is subsequently actuated after the predetermined actuation time period 184, the motor 144 may again operate in the batch mode, in accordance with step 202. The predetermined actuation time period 184 may, for example, begin when the main actuation switch 160 is de-actuated before the subsequent actuation.

Figure 4:
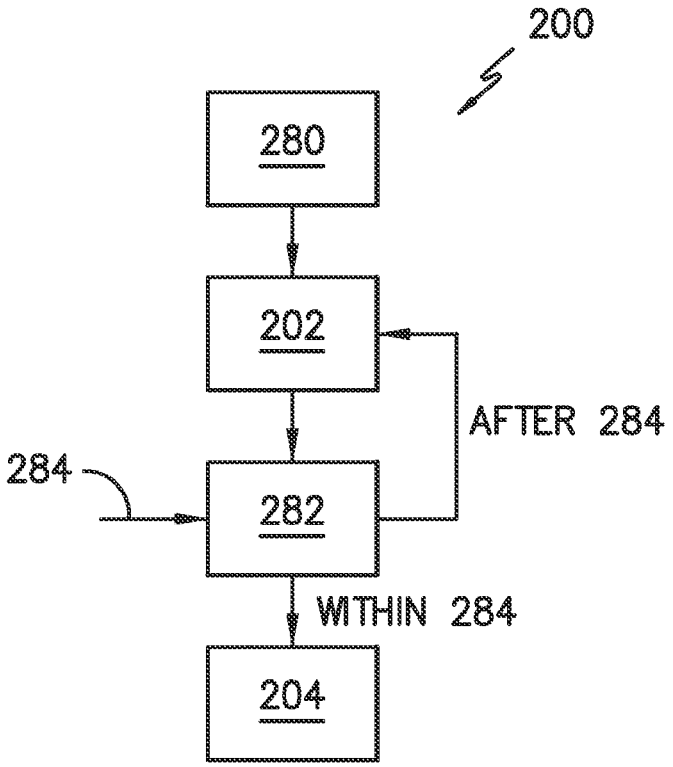
FIG. 4 is a flow chart illustrating a method in accordance with one embodiment of the present disclosure.

The present disclosure is further directed to methods for operating disposal assemblies 100. As illustrated in FIG. 4, and further in FIGS. 5 through 7, a method 200 may include the step 202 of operating a motor 144 of the disposal assembly 100 in a batch mode after a main actuation switch 160 is actuated in accordance with step 180, as discussed herein. A method 200 may further include the step 204 of operating a motor 144 of the disposal assembly 100 in a continuous mode after a main actuation switch 160 is subsequently actuated in accordance with step 182, as discussed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A disposal assembly, comprising:

an inlet conduit defining an inlet passage;

a housing defining a chamber, the chamber in fluid communication with the inlet passage;

a grinding mechanism disposed within the chamber;

a motor connected to the grinding mechanism and operable to drive the grinding mechanism;

a stopper, the stopper positionable within the inlet passage;

a batch actuation assembly, the batch actuation assembly comprising a first actuation component disposed in the inlet conduit and a second actuation component disposed in the stopper; and a controller in communication with the motor, the controller comprising a non-transitory computer readable medium configured with a program to selectively and alternately operate the motor in a batch mode and a continuous mode, wherein the batch mode comprises operating the motor when a main actuation switch is actuated and the batch actuation assembly is actuated, and discontinuing operation of the motor if a predetermined motor time period is met, and wherein the continuous mode comprises operating the motor when the main actuation switch is actuated, and discontinuing operation of the motor when the main actuation switch is de-actuated.

2. The disposal assembly of claim 1, wherein the first actuation component is a reed switch and the second actuation component is a magnet.

3. The disposal assembly of claim 1, further comprising a current sensor in communication with the controller and the motor, the current sensor operable to sense a current level in the motor.

4. The disposal assembly of claim 1, wherein sequential actuation of the main actuation switch causes the controller to alternate between operating the motor in the batch mode and operating the motor in the continuous mode.

5. The disposal assembly of claim 1, wherein operation in the batch mode further comprises:

initiating a motor countdown timer for the predetermined motor time period when a current level of the motor is below a predetermined current level; and discontinuing the motor countdown timer if the current level rises above the predetermined current level.

6. The disposal assembly of claim 1, wherein operation in the continuous mode further comprises:

operating the motor when the main actuation switch is actuated;

initiating a motor countdown timer for a predetermined motor time period when a current level of the motor is below a predetermined current level;

discontinuing operation of the motor if the predetermined motor time period is met; and discontinuing the motor countdown timer if the current level rises above the predetermined current level.

7. The disposal assembly of claim 1, further comprising a faucet assembly, the faucet assembly comprising a faucet and a flow valve, the flow valve in communication with the controller.

* * * * *